US011213456B2

(12) United States Patent
Cissell

(10) Patent No.: US 11,213,456 B2
(45) Date of Patent: Jan. 4, 2022

(54) APPARATUS FOR PROVIDING INSTANT ACCESS TO A MEDICAL VIAL AND A METHOD FOR USING THE SAME

(71) Applicant: Jay Zachary Zuppardo, Temecula, CA (US)

(72) Inventor: Maverick Cissell, Temecula, CA (US)

(73) Assignee: Zachary Zuppardo, Temecula, CA (US)

( * ) Notice: Subject to any disclaimer, the term of this patent is extended or adjusted under 35 U.S.C. 154(b) by 77 days.

(21) Appl. No.: 16/822,443

(22) Filed: Mar. 18, 2020

(65) Prior Publication Data

US 2021/0121362 A1 Apr. 29, 2021

Related U.S. Application Data

(60) Provisional application No. 62/926,242, filed on Oct. 25, 2019.

(51) Int. Cl.
*A61J 1/20* (2006.01)

(52) U.S. Cl.
CPC ..... *A61J 1/2096* (2013.01); *A61J 1/201* (2015.05); *A61J 1/2037* (2015.05); *A61J 1/2075* (2015.05); *A61J 2200/10* (2013.01)

(58) Field of Classification Search
CPC ..... A61J 1/2096; A61J 1/201; A61J 1/2075; A61J 1/2037; A61J 2200/10
USPC ..... 141/2, 23, 353
See application file for complete search history.

(56) References Cited

U.S. PATENT DOCUMENTS

| | | | | |
|---|---|---|---|---|
| 2,326,490 | A | 8/1943 | Perelson | |
| 5,060,704 | A | 10/1991 | Rohrbough | |
| 5,423,791 | A | 6/1995 | Bartlett | |
| 5,527,306 | A | 6/1996 | Haining | |
| 5,620,434 | A | 4/1997 | Brony | |
| 5,685,866 | A * | 11/1997 | Lopez | A61M 5/14 604/249 |
| 5,833,213 | A | 11/1998 | Ryan | |
| 8,210,166 | B2 | 7/2012 | Denton | |
| 8,684,992 | B2 | 4/2014 | Sullivan | |
| 9,173,815 | B2 | 11/2015 | Davidson | |
| 9,345,642 | B2 | 5/2016 | Heath | |
| 10,258,541 | B2 | 4/2019 | Cheng | |
| 10,278,897 | B2 | 5/2019 | David | |

(Continued)

FOREIGN PATENT DOCUMENTS

| | | |
|---|---|---|
| WO | 2012004784 | 1/2012 |
| WO | 2012150587 | 11/2012 |

*Primary Examiner* — Jason K Niesz
(74) *Attorney, Agent, or Firm* — Marcus C. Dawes

(57) ABSTRACT

A sealing device for a medication vial which is highly efficient and easy to use. The sealing device comprises a valve and a compressible stopper. Fitted vertically on top the valve and stopper is a coupling portion. When a syringe is coupled to the sealing device, the syringe compresses the stopper which in turn exposes an aperture defined in a central neck portion of the valve. As medication is withdrawn from the vial, the medication enters the valve and travels through the central neck where it then exits through its open apertures and subsequently into the syringe itself. As the syringe is withdrawn, the stopper is allowed to expand or relax which again closes the apertures defined within the central neck of the valve, thereby ceasing the flow of medication through the sealing device.

19 Claims, 6 Drawing Sheets

(56) References Cited

U.S. PATENT DOCUMENTS

| | | | | |
|---|---|---|---|---|
| 2004/0034325 | A1 | 2/2004 | Lopez | |
| 2005/0151105 | A1* | 7/2005 | Ryan | A61M 39/26 251/149.6 |
| 2005/0159724 | A1 | 7/2005 | Enerson | |
| 2015/0265500 | A1 | 9/2015 | Russo | |
| 2019/0321262 | A1* | 10/2019 | Chudek | A61J 1/16 |
| 2019/0343723 | A1* | 11/2019 | Klimek | A61J 1/2051 |

* cited by examiner

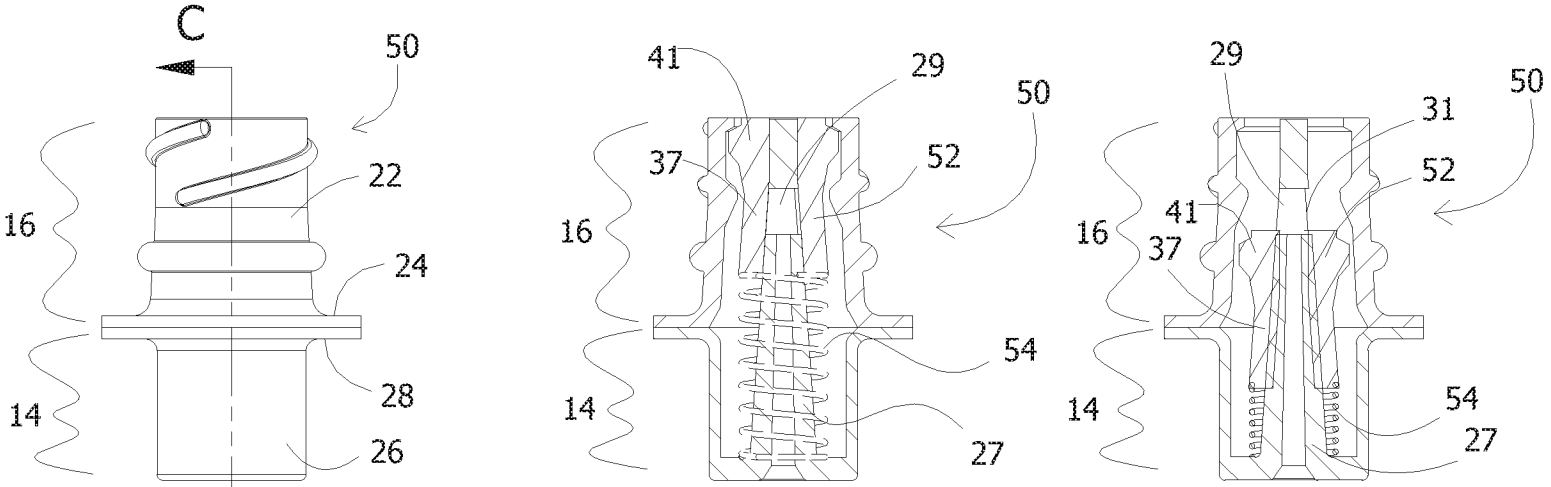
Fig. 7A
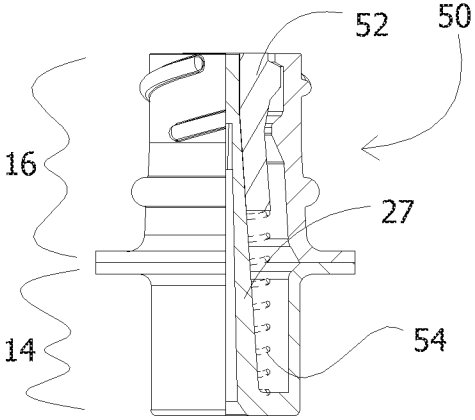
Fig. 7B
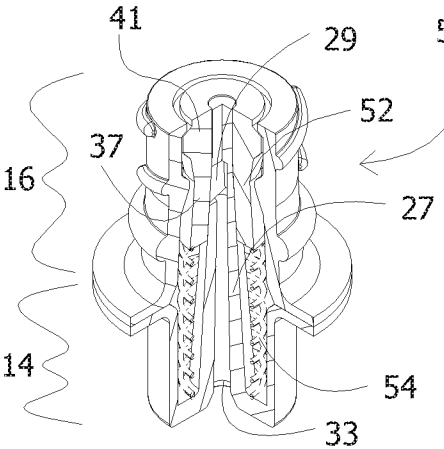
Fig. 7C
Fig. 8A
Fig. 8B

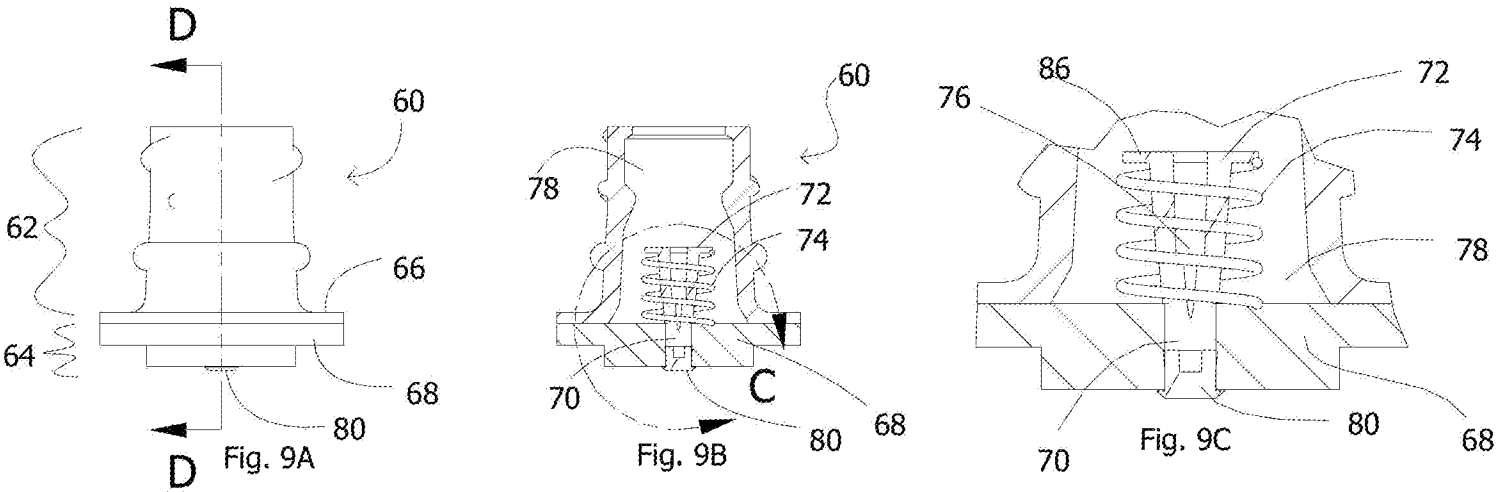
60
62
64
66
68
80
D
D
Fig. 9A
60
72
74
78
68
80
70
C
Fig. 9B
72
74
78
68
80
70
76
86
Fig. 9C
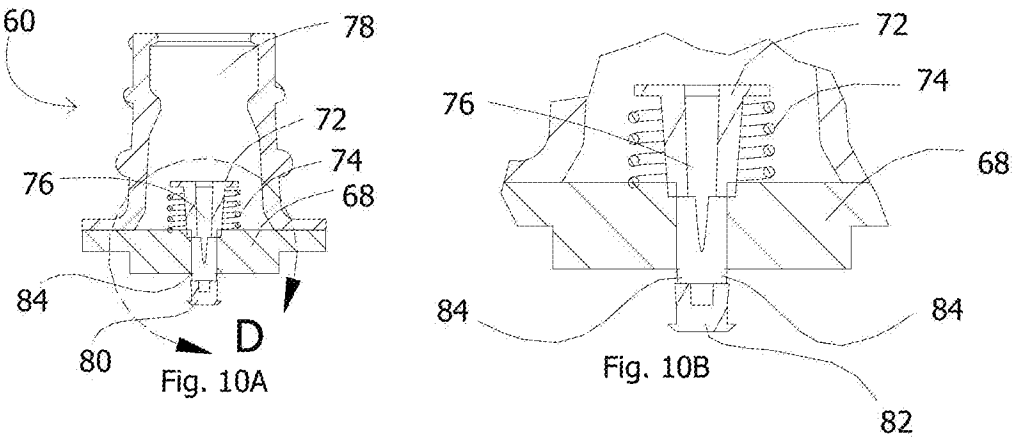
60
78
72
74
68
D
80
76
84
Fig. 10A
72
74
68
84
82
76
84
Fig. 10B

APPARATUS FOR PROVIDING INSTANT ACCESS TO A MEDICAL VIAL AND A METHOD FOR USING THE SAME

RELATED APPLICATIONS

The present application is a non-provisional of U.S. provisional application Ser. No. 62/926,242 filed on Oct. 25, 2019, which is incorporated herein by reference and to which priority is claimed pursuant to 35 USC 120.

BACKGROUND

Field of the Technology

The invention relates to the field of caps and valves for medical vials, specifically a valve allowing for instant access to a medication vial which does not require the use of a needle or additional attachments.

Description of the Prior Art

Liquid medications have long be stored and transported within small vials which are principally comprised of glass or plastic. The vial typically is formed with an internal volume and comprises a cap disposed over a top portion of the vial. The cap may be coupled to the vial through a corresponding pair of threads or may "snap" onto the vial through a friction fit. However, by far the most common type of cap disposed on many vials is a metal ring with a rubber or other self-sealing material disposed in the center thereof. Many medication vials also comprise a removable foil seal or other lid which functions as a safety seal or tamper proof seal to let the user know if the medication within the vial has been previously accessed.

The most common and simplest way to withdraw medication from the medication vial of the prior art is to insert the needle of a syringe so that the needle penetrates the rubber seal and enters the medication beneath. The user then withdraws the plunger of the syringe which draws the medication up through the needle and into the syringe. When the proper dosage of medication has been withdrawn, the needle is pulled out of the vial with the rubber seal automatically self-sealing the cap as soon as the needle has been removed. The now medication-filled syringe may then be used directly on a patient or alternatively inserted into an intravenous line as is known in the art. However, because a needle is being used, this increases the risk that the user accidently sticks or punctures themselves with the needle, especially if the user is trying withdraw medication quickly or is in a moving vehicle such as an ambulance.

Additional devices and methods have also been developed that allows user to withdraw medication from a medication vial using a needleless syringe. These devices principally include a housing or other attachment which is selectively coupled to a standard medication vial along with an internal needle or plunger disposed therein. The user inserts a needless syringe into the device which in turn actuates the internal needle or plunger so that it penetrates the self-sealing rubber seal of the medication vial, allowing medication to be drawn therefrom. The device also comprises a spring or other resilient means for retracting the needle or plunger automatically as soon as the needleless syringe is removed from the device. Some variations of the device also comprise a luer-lock or other means for temporarily locking or connecting the needleless-syringe to the medication vial attachment. However another problem develops since these attachments require the user to first properly couple the attachment to the medication vial before the needleless syringe may be attached which can be a costly time consuming process, especially if the medication being given to the patient is required during an emergency. Additionally, having an attachment device requires additional storage space which may not always be readily available, particularly if the user withdrawing the medication is a paramedic or firefighter and storage space is at a premium.

What is needed therefore is a sealing device for a medication vial which is quick and easy to use and which does not require the use of a needle. The device should also be integrated into the medication vial itself, thereby preventing the need for the user to first attach another device or component to the vial before medication can be withdrawn.

BRIEF SUMMARY

The current invention provides an apparatus for selectively withdrawing a fluid from a medication vial. The apparatus includes a valve disposed within a mouth of the medication vial, a coupling portion coupled to the valve, and a stopper disposed within an internal volume of the valve. The stopper has the ability to vary its vertical position relative to the valve. The valve itself has at least one aperture defined therein. The stopper further includes the ability to close the at least one aperture when in an expanded configuration as well as the ability to open the at least one aperture when in a compressed configuration.

In one embodiment, the ability of the stopper to vary its vertical position relative to the valve is performed by a plurality of compressible pleats that are defined along the height of the stopper.

In another embodiment, the stopper has an internal channel to accommodate the at least one aperture defined in the valve.

In yet another embodiment, the valve includes a central neck with a hollow interior, an inlet defined in a bottom surface of the valve which is fludically communicated to the hollow interior, and a tip coupled to the central neck. In this embodiment, the at least one aperture is defined in the tip. Additionally, the ability of the stopper to close the at least one aperture when in an expanded configuration includes a flange that is configured to close the at least one aperture defined in the tip. Furthermore, the inlet that is defined in the bottom surface of the valve is fluidically communicated to the fluid within the medication vial. This embodiment further includes a top portion of the stopper which is configured to contact the syringe when it is coupled to the coupling portion.

In a related embodiment, the coupling portion of the apparatus includes an external structure for coupling the apparatus to a syringe.

The invention also includes a method for withdrawing a fluid from a vial. The method includes connecting a syringe to a coupling portion which itself is attached to a valve, actuating a stopper disposed within an internal volume of the valve, and opening an aperture defined in the valve. Next, the fluid is withdrawn from the vial through the valve and into the syringe and the aperture defined in the valve is closed. The syringe is the disconnected from the coupling portion. Specifically, actuating the stopper disposed within an internal volume of the valve includes automatically compressing the stopper as the syringe is coupled to the coupling portion, while closing the aperture defined within the valve includes automatically closing the aperture defined within the valve as the syringe is decoupled from the coupling portion.

In one embodiment, closing the aperture defined in the valve specifically includes covering the aperture with a flange disposed on the stopper.

In another embodiment, compressing the stopper as the syringe is coupled to the coupling portion is done by compressing a plurality of pleats defined along a height of the stopper. Relatedly, closing the aperture defined in the valve in this embodiment is done by expanding the plurality of pleats defined along the height of the stopper as the syringe is disconnected from the coupling portion.

In yet another embodiment, actuating the stopper disposed within an internal volume of the valve includes varying a vertical position of the top of the stopper relative to the aperture defined in the valve. More specifically, varying the vertical position of the top of the stopper relative to the aperture defined in the valve is done by varying a vertical position of the top of the stopper relative to a stationary central neck disposed through an internal channel of the stopper.

In a further embodiment, withdrawing the fluid from the vial through the valve and into the syringe includes withdrawing the fluid through a hollow interior defined within a central neck within the valve.

In one embodiment, the method also includes inserting a central neck of the valve into a distal locking portion of the syringe. In this embodiment, the method step of opening the aperture defined in the valve occurs simultaneously as the central neck is inserted into the distal locking portion of the syringe. Additionally, the step of withdrawing the fluid from the vial through the valve and into the syringe in this particular embodiment includes withdrawing the fluid from a tip of the central neck directly into the distal locking portion of the syringe.

In another embodiment, automatically compressing the stopper as the syringe is coupled to the coupling portion is done by specifically pushing a top portion of the stopper with a distal portion of the syringe. Additionally, automatically closing the aperture defined within the valve as the syringe is decoupled from the coupling portion specifically includes relaxing the top portion of the stopper with the distal portion of the syringe.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

FIG. 7A is a side view of an alternative embodiment of the sealing device of the current invention.

FIG. 7B is a partial cross sectional or cut away side view of the sealing device seen in FIG. 7A.

FIG. 7C is a partial cross sectional or cut away perspective view of the sealing device seen in FIG. 7A.

FIG. 8A is a cross sectional view of the sealing device taken through line C-C seen in FIG. 7A with a spring disposed in the sealing device is in an expanded configuration.

FIG. 8B is a cross sectional view of the sealing device taken through line C-C seen in FIG. 7A with the spring disposed in the sealing device is in a compressed configuration.

FIG. 9A is a side view of an alternative embodiment of the sealing device of the current invention.

FIG. 9B is a side cross sectional of the alternative embodiment of the sealing device taken through line C-C seen in FIG. 9A when a spring disposed in the sealing device is in an expanded configuration.

FIG. 9C is a magnified cross sectional side view of the detail contained within circle C seen in FIG. 9B.

FIG. 10A is a side cross sectional of the alternative embodiment of the sealing device taken through line C-C seen in FIG. 9A when a spring disposed in the sealing device is in a compressed configuration.

FIG. 10B is a magnified cross sectional side view of the detail contained within circle T seen in FIG. 10A.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
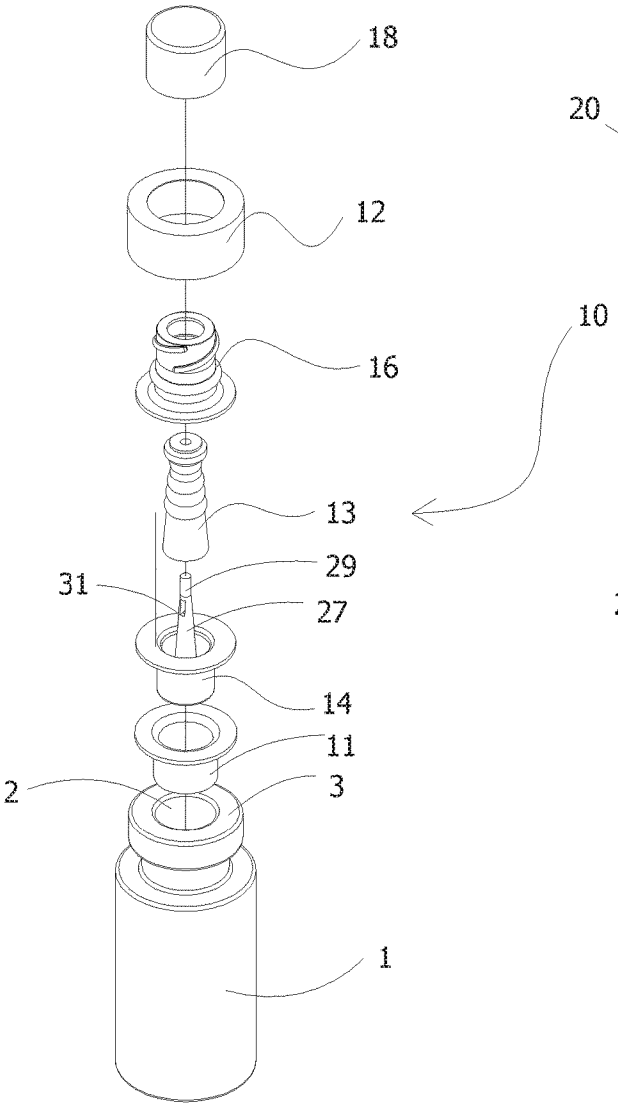
FIG. 1 is an exploded view of the sealing device of the current invention.

The current invention solves these and other problems by providing a sealing device for a medication vial which is highly efficient and easy to use, even in emergency situations where time and available space can drastically change the treatment of a patient requiring medical attention. The sealing device is seen in the figures and is denoted generally by reference numeral 10. As best seen in the exploded view of FIG. 1, the sealing device 10 comprises a valve 14 which is substantially configured to fit or nest within a seat 11 which in turn is configured to fit or nest within the neck portion 3 of a standard medication vial 1. Disposed on and removably coupled to the valve 14 is a compressible stopper 13. Fitted vertically on top or above the valve 14 and stopper 13 is a coupling portion 16 which, along with the valve 14 and stopper 13, are held in a fixed position relative to the medication vial 1 via a crimp connection or crimping ring 12. Removably coupled to the coupling portion 16 is a cap 18 which is configured to selectively engage with the coupling portion 16.

Figure 2A:
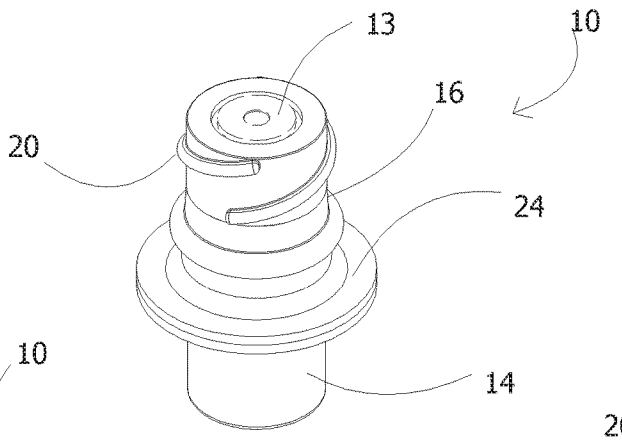
FIG. 2A is a three quarter perspective view of the sealing device of the current invention.
Figure 2B:
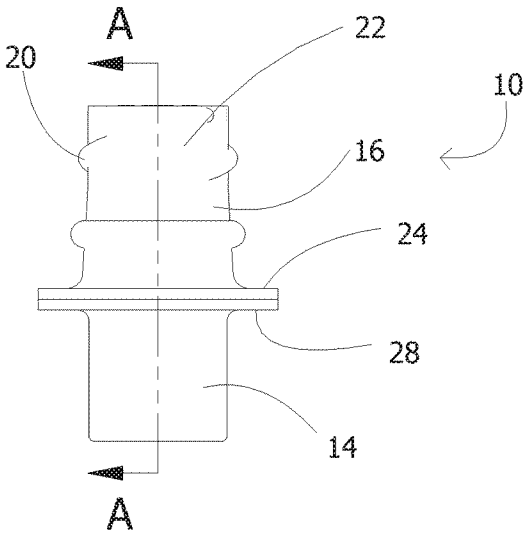
FIG. 2B is a side view of the sealing device seen in FIG. 2A.

In FIGS. 2A and 2B, the sealing device 10 may be seen in a three quarter and a side perspective, respectively. In one preferred embodiment, the cap 18 comprises an internal female thread while the coupling portion 16 comprises a corresponding male thread 20 disposed around the outside surface of a substantially cylindrical and vertically orientated sleeve 22. The female thread of the cap 18 and the male thread 20 of the sleeve 22 preferably cooperate to form a Luer-lock, however it is to be expressly understood that the threads may be sized, configured, or disposed on their respective components so as to form any fitting which creates a leak-proof connection for a fluid to traverse there through. Alternatively, the cap 18 and the sleeve 22 of the coupling portion 16 do not comprise any threads or protrusions at all and instead comprise complimentary surfaces which are configured to fit or press together in a friction or "snap" fit. In yet another embodiment, the coupling portion 16 and the valve 14 may be formed from one single structural component or piece. In other words, the valve 14 may comprise a coupling portion on the valve itself, thereby bypassing the need to manufacture different parts or to couple the coupling portion 16 and the valve 14 together.

The coupling portion 16 further comprises an apron 24 which radially extends in a perpendicular direction relative to the vertical surface of the sleeve 22 and matches a lip 28 which extends radially from a top portion of a cylindrical body portion of the valve 14. The apron 24 and lip 28 remain in contact with each other when the sealing device 10 is in use and both the apron 24 and lip rest upon an outer rim of the seat 11 which in turn remains within a mouth 2 of the medication vial 1.

Figure 3:
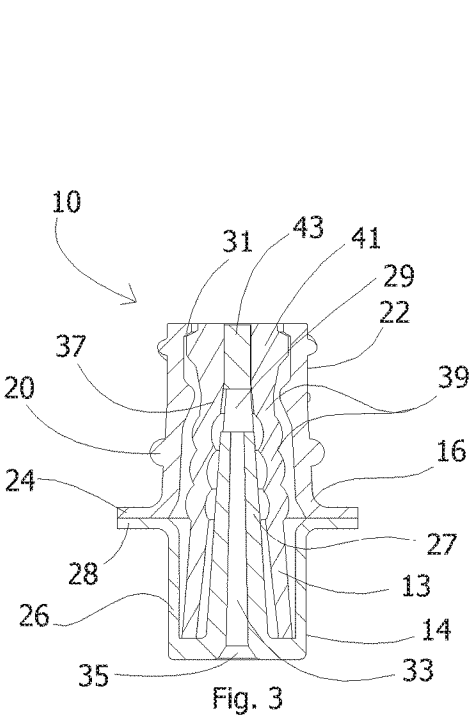
FIG. 3 is a cross sectional view of the sealing device taken through line A-A seen in FIG. 2B.
Figure 4B:
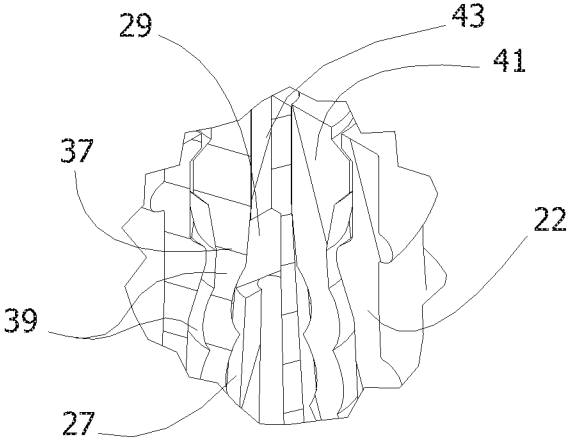
FIG. 4B is a magnified partial cross sectional perspective view of the detail contained within circle A seen in FIG. 4A.
Figure 4A:
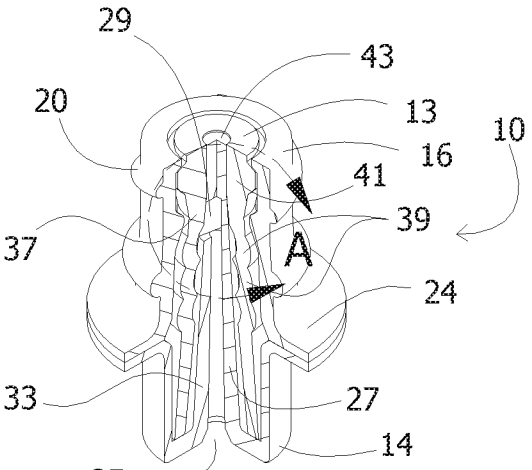
FIG. 4A is a partial cross sectional or cut away perspective view of the sealing device seen in FIG. 2A.

Turning to FIGS. 3, 4A, and 4B, greater detail of how the components of the sealing device 10 fit and cooperate together may be had. Specifically the valve 14 is inserted into the seat 11 which is in turn inserted into the mouth 2 of a standard medication valve 1 used to store and transport various liquid medications. The valve 14 comprises a substantially cylindrical body 26 which itself comprises a central neck 27 that is substantially conical in shape with a wide cross sectional diameter close to a bottom portion of the valve 14 which narrows or tapers along a vertical height and terminates in a tip 29. The conical central neck 27 comprises a hollow interior 33 which is fluidically coupled to an inlet 35 defined in a bottom surface of the valve 14. The tip 29 comprises at least one aperture or opening 31 which is itself fluidically coupled with the interior 33 of the central neck 27, thereby forming a complete fluid path through the valve 14 that is specifically defined between the inlet 35 and the aperture 31. The body 26 of the valve 14 closely matches the diameter of a neck 3 of the medication vial 1 so as to form a tight or close fit with the internal surface of the neck 3. When the body 26 of the valve 14 is disposed in the neck 3 of the medication vial 1, the lip 28 rests or remains disposed on the seat 11 which in turn rests on mouth 2 of the medication valve 1, thereby helping to maintain the valve 14 within the neck 3 and prevent it from sliding further downward into the medication vial 1.

The stopper 13 as seen in FIGS. 3, 4A, and 4B comprises a hollow interior or volume which is slightly tapered so as to accommodate the central neck 27 of the valve 14 therein. Specifically, as best seen in the cross sectional view of FIG. 3, the bottom portion or edge of the stopper 13 rests on the bottom surface of the valve 14 with the central neck 27 nested or accommodate disposed inside and along a longitudinal axis of the stopper 13. The stopper 13, which is preferably comprised of silicon, rubber, or other suitable malleable material, is tapered along its height so that a circumferential flange 37 which is disposed near a top portion of the stopper 13 is disposed directly adjacent to the at least one aperture 31 defined in the tip 39 of the valve 14 so as to effectively block or seal the aperture 31. The stopper 13 further comprises a plurality of pleats 39 below a top portion 41. The pleats 39 are flexible and may be compressed, thereby reducing the overall height of the stopper 13 as is detailed further below. The top portion 41 of the stopper 13 also comprises an internal channel 43 which is defined throughout the entire height of the stopper 13.

As also seen in FIG. 3, the coupling portion 16 is disposed vertically and directly on top or above the valve 14. Specifically, the apron 24 of the coupling portion 16 is placed in direct contact with the lip 28 of the valve 14 so that both the apron 24 and the lip 28 are stacked upon one another and forms a casing or sealed housing around the inner components of the valve 14 and the stopper 13. The inlet 35 of the valve 14 is a substantially cylindrical aperture which is coaxial with the body 26 of the valve 14, the hollow interior 33 of the central neck 27, and the internal channel 43 of the stopper 13. Next, the crimping connection 12 is brought down over the mouth 3 of the medication vial 1 and then bent or deformed over the circumference of the mouth 3, thereby locking in or fixing the valve 14 and coupling portion 16 at their respective positions seen in FIG. 3 with the stopper 13 disposed therein. The deformation of the crimping connection 12 also ensures that the inlet 25 of the valve 14 remains securely in place throughout the use of the device 10.

Figure 6:
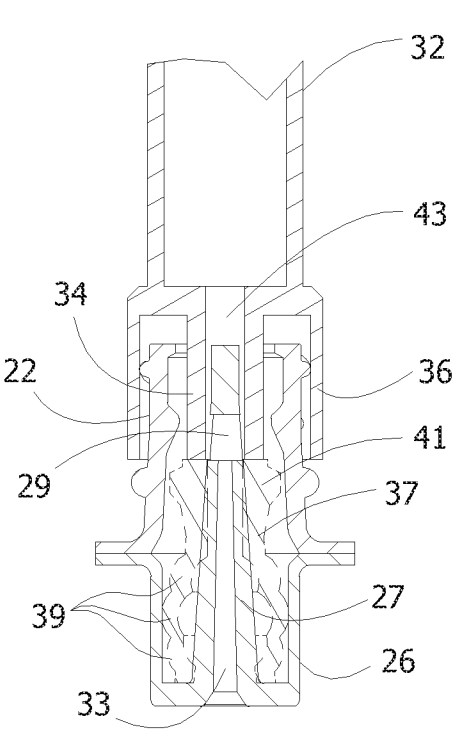
FIG. 6 is a cross sectional view of the sealing device seen in FIG. 5B as the syringe compresses a stopper disposed within the sealing device.
Figure 5B:
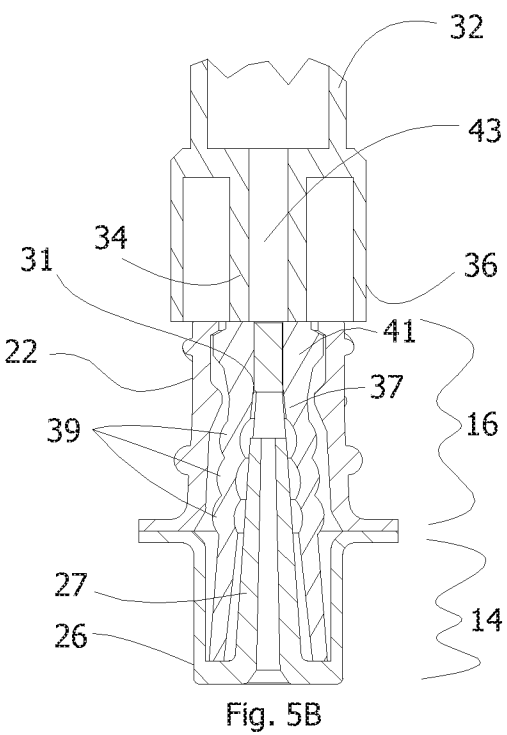
FIG. 5B is a cross sectional view of the syringe being coupled to the sealing device seen in FIG. 5A.
Figure 5A:
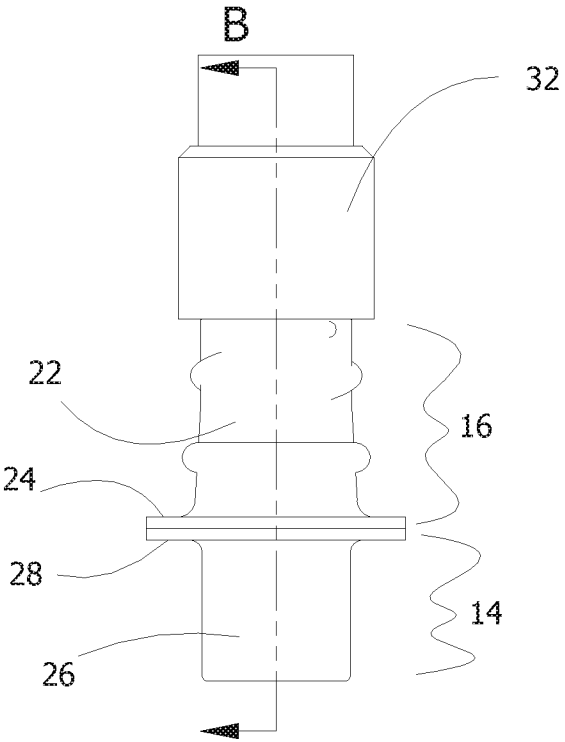
FIG. 5A is a side view of the sealing device seen in FIG. 2A as a syringe is being coupled to the sealing device.
Figure 11B:
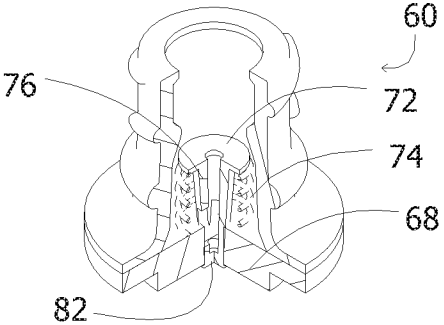
FIG. 11B is a partial cross sectional or cut away perspective view of the sealing device seen in FIG. 11A.
Figure 11A:
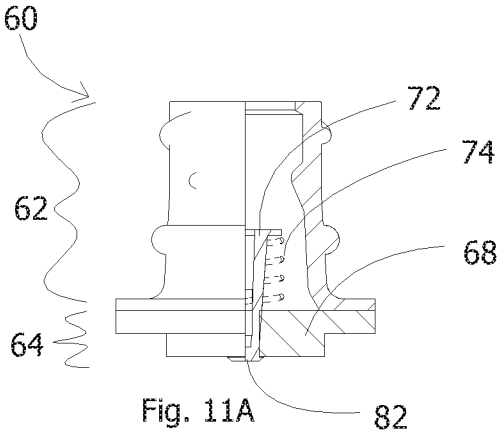
FIG. 11A is a partial cross sectional or cut away side view of the sealing device seen in FIG. 9A.

To use the sealing device 10, a needleless syringe 32 or other appropriate device is brought towards the coupling portion 16 after the cap 18 has been removed as seen in FIGS. 5A-6. Specifically, a distal locking portion 36 of the syringe 32 is aligned with an aperture defined within the sleeve 22 of the coupling portion 16. As the syringe 32 and the coupling portion 16 are brought closer together, the distal locking portion 36 is slid or disposed over the outside surface of the sleeve 22 including the male thread 20 disposed thereon as best seen in FIGS. 5A and 5B. Next, the user then axially rotates the syringe 32 relative to the medication vial 1 so that female threads defined within the inner surface of the distal locking portion 36 engages or is seated onto the male threads 20 of the coupling portion 16. Alternatively, the distal locking portion 36 may be engaged with the coupling portion 16 through a snap or friction fit by forcibly pushing the syringe 36 distally into the medication vial 1 or by engaging some another locking mechanism now known or later devised.

Greater detail of the internal function and coupling of the sealing device 10 is seen in FIGS. 5B and 6. Turning to FIG. 5B, as an adapter 34 extending from the distal locking portion 36 enters the sleeve 22, the distal edge of the adapter 34 makes contact with the top portion 41 of the stopper 13 and begins to compress the stopper 13. At the same time, the tip 29 of the valve 14 enters an internal volume 43' defined within the adapter 34. Because the stopper 13 is comprised of silicon or other similarly flexible material while the valve 14 including the central neck 27 and tip 29 is comprised of plastic or other sufficiently rigid material, the stopper 13 continues to deform and compress while the tip 29 remains in a fixed position as it enters the internal volume 43' of the adapter 34. The adapter 34 comprises a substantially cylindrical shape with an external diameter which is small enough to fit within or be accommodated by the sleeve 22 of the coupling portion 16, but yet large enough to accommodate the circumference of the tip 29 therein.

As the user continues to push the syringe 32 into the sealing device 10, the adapter 34 continues to push into the stopper 13 and move it downward towards the bottom surface of the valve 14, thereby causing it to compress along its height, specifically along its pleats 39 which are integrally formed within the surface of the stopper 13 itself as seen in FIG. 6. As the stopper 13 is compressed, the top portion 41 including the flange 37 are also move downward relative the central neck 27, thereby exposing the opening 31 defined within the tip 29 and creating an open path or channel for fluid to flow between the medication vial 1 and the syringe 32.

After the coupling portion 16 has been fully inserted into the distal locking portion 36 of the syringe 32 and secured as discussed above, the movement of the adapter 34 ceases and the stopper remains in a deformed configuration as seen in FIG. 6 with the opening 31 disposed at a maximum open position.

Next, the user actuates a plunger disposed in the syringe 32 to withdraw medication from the medication vial 1 as is known in the art by pulling the plunger proximally away from the medication vial 1. Specifically, medication fluid disposed within the medication vial 1 is drawn into the valve 14 by first entering the hollow interior 33 through the inlet 35. As the user continues to withdraw the plunger, the medication fluid is drawn upward through the hollow interior 33 of the central neck 27 until entering the tip 29 where it then exits through the at least one opening 31 and enters the internal channel 43' centrally defined through the adapter 34 and then into the internal volume of the syringe 32 itself where the user can observe how much medication fluid has been withdrawn. Once the proper dosage of medication fluid has been obtained, the user stops withdrawal of the plunger within the syringe 32 which in turn stops the flow of fluid through the central neck 27 disposed within the valve 14. Next, the user decouples or removes the syringe 32 from the sealing device 10 by either disengaging the female threads of the distal locking portion 36 from the male threads 20 disposed on the coupling portion 16, or by simply pulling the syringe 32 in the proximal direction away from the medication vial 1 so as to release the friction or interference fit disposed there between. As the adapter 34 is pulled proximally away from the valve 14, the adapter 34 is removed from the sleeve 22 of the coupling portion 16 which allows the stopper 13 to relax or expand back into its initial form as seen in FIG. 5B. More specifically, the resilient, semi-elastic material of the stopper 13 permits the stopper 13 to expand or return to its original unstressed position which naturally and automatically obstructs or closes the opening 31 defined in the tip 29 so as to reseal or plug the passageway previously formed between the hollow interior 33 and the surrounding environment formed by the combined structure of the coupling portion 16 and the valve 14. The closing or resealing of the opening 31 stops all fluid flow to or from the medication vial 1, even if the medication vial 1 itself is inverted. The user continues to remove the syringe 32 so that the adapter 34 is pulled from the sleeve 22 of the coupling portion 16 thereby clearing the syringe 32 from the sealing device 10 completely. The user may then reattach or recouple the cap 18 to the coupling portion 16 if needed.

Having removed from the syringe 32 filled the medication fluid from the sealing device 10, the user may apply a needle to the syringe 32, apply the syringe 32 to an intravenous tube or bag, or perform any other procedure requiring a syringe as is known in the art or later devised. Alternatively, the user may reinsert the syringe 32 into the sealing device 10 and reopen the opening 31 as disclosed above and either draw more medication fluid, or reinject the medication fluid contained within the syringe 32 back into the medication vial 1. Because of the close seated or tight connection which is formed between the syringe 32 and the medication vial 1 via the sealing device 10, anytime medication fluid is taken from or injected into the medication vial 1 air is prevented from being withdrawn by the syringe 32 upon its actuation, thereby allowing the user to immediately withdraw medication fluid without having to adjust for any air which may have been inadvertently permitted to enter the syringe 32. In emergency conditions, this further allows the user to inject or apply the medication fluid or drug more quickly to the patient which in turn could improve their medical treatment or even potentially be lifesaving.

It is to be expressly understood that the valve 14 described above which comprises a central neck 27 and gated by a flexible stopper 13 is meant to be for illustrative purposes only. Other types or forms of valves, gates, or gaskets now known or later devised including but not limited to butterfly valves, check valves, plug valves, and/or pinch valves may be used without departing from the original spirit and scope of the invention.

For example, an alternative embodiment of the sealing device 50 may be seen in FIGS. 7A-8B. Here, the coupling portion 16 and valve 14 are substantially similar to what is discussed above with regard to FIGS. 1-6, however the alternative sealing device 50 here comprises a spring 54 disposed within the housing formed by the stacked coupling portion 16 and the valve 14. Additionally, the sealing device 50 comprises a modified stopper 52 which is similar to the stopper 13 seen in FIG. 1 with the exception that the modified stopper 52 does not comprise any pleats and is therefore shorter or otherwise comprises an overall smaller height as compared to the stopper 13 of the previous embodiment. The modified stopper 52 however does comprise a top portion 41 with a flange 37 as detailed above. The spring 54 is coupled to a bottom surface of the valve 14 at one end while being coupled to a bottom portion of the stopper 52 at its corresponding opposing end.

To use the sealing device 50, and a after a needleless syringe 32 or other appropriate device has been coupled or attached to the coupling portion 16 in the same manner detailed above, the adapter 34 extending from the distal locking portion 36 (not shown in FIGS. 7A-8B for clarity) enters the sleeve 22 of the coupling portion. As the distal edge of the adapter 34 makes contact with the modified stopper 52, the modified stopper 52 begins to move in a downward direction relative to the central neck 27 it is disposed around. At the same time, the tip 29 of the valve 14 enters an internal volume 43' defined within the adapter 34. Because the modified stopper 52 is coupled to the spring 54, the spring 54 begins to compress while the tip 29 remains in a fixed position as it enters the internal volume 43' of the adapter 34. The adapter 34 comprises a substantially cylindrical shape with an external diameter which is small enough to fit within or be accommodated by the sleeve 22 of the coupling portion 16, but yet large enough to accommodate the circumference of the tip 29 therein.

As the user continues to push the syringe 32 into the sealing device 10, the adapter 34 continues to push into the modified stopper 52 and move it downward towards the bottom surface of the valve 14, thereby causing the spring 54 to compress into a compact configuration seen in FIG. 8B. As the modified stopper 52 is compressed, the top portion 41 including the flange 37 are also move downward relative the central neck 27, thereby exposing the opening 31 defined within the tip 29 and creating an open path or channel for fluid to flow between the medication vial 1 and the syringe 32.

After the coupling portion 16 has been fully inserted into the distal locking portion 36 of the syringe 32 and secured as discussed above, the movement of the adapter 34 ceases and the spring 54 remains in a compressed configuration as seen in FIG. 8B with the opening 31 disposed at a maximum open position. Next, the user actuates a plunger disposed in the syringe 32 to withdraw medication from the medication vial 1 as is discussed above then detaches the syringe 32 from the coupling portion 16 once a desired medication dosage has been obtained. As the adapter 34 is pulled proximally away from the valve 14, the adapter 34 is removed from the sleeve 22 of the coupling portion 16 which allows the spring 54 to relax or expand back into its initial form as seen in FIGS. 7C and 8A. More specifically, the resilient, semi-elastic material of the spring 54 permits the modified stopper 52 to return to its original position which naturally and automatically obstructs or closes the opening 31 defined in the tip 29 so as to reseal or plug the passageway previously formed between the hollow interior 33 and the surrounding environment formed by the combined structure of the coupling portion 16 and the valve 14. The closing or resealing of the opening 31 stops all fluid flow to or from the medication vial 1, even if the medication vial 1 itself is inverted. The user continues to remove the syringe 32 so that the adapter 34 is pulled from the sleeve 22 of the coupling portion 16 thereby clearing the syringe 32 from the sealing device 50 completely.

Having removed from the syringe 32 filled the medication fluid from the sealing device 50, the user may apply a needle to the syringe 32, apply the syringe 32 to an intravenous tube or bag, or perform any other procedure requiring a syringe as is known in the art or later devised. Alternatively, the user may reinsert the syringe 32 into the sealing device 50 and reopen the opening 31 as disclosed above and either draw more medication fluid, or reinject the medication fluid contained within the syringe 32 back into the medication vial 1. Because of the close seated or tight connection which is formed between the syringe 32 and the medication vial 1 via the sealing device 50, anytime medication fluid is taken from or injected into the medication vial 1 air is prevented from being withdrawn by the syringe 32 upon its actuation, thereby allowing the user to immediately withdraw medication fluid without having to adjust for any air which may have been inadvertently permitted to enter the syringe 32. In emergency conditions, this further allows the user to inject or apply the medication fluid or drug more quickly to the patient which in turn could improve their medical treatment or even potentially be lifesaving.

Yet another embodiment of the sealing device 60 may be seen in FIGS. 9A-11B. Here, the sealing device 60 comprises a coupling portion 62 and a valve 64 which comprises a base 68 which matches an apron 66 of the coupling portion 62. The base 68 also comprises an aperture 70 defined through its thickness within a substantially central portion of the base 68 which comprises a substantially circular surface. The alternative sealing device 60 here comprises a plug 72 and spring 74 disposed within an internal volume 78 of the coupling portion 62. The plug 72 comprises a substantially inverted conical shape with a lumen 76 defined through the height of the plug 72. The spring 74 is coupled to an upper surface of the base 68 at one end while being coupled to an extended flange 86 at the proximal end of the plug 72 at its corresponding opposing end. Disposed at the distal end of the plug 72 is a cap 80. The cap 80 is shaped such that it rests on a lower surface of the base 68 as best seen in FIG. 9C. The plug 72 further comprises a plurality of apertures 84 which are defined through the surface of the plug 72 which provide a fluidic pathway to the lumen 76 within the plug 72 itself.

To use the sealing device 60, and a after a needleless syringe 32 or other appropriate device has been coupled or attached to the coupling portion 16 in the same manner detailed above, the adapter 34 extending from the distal locking portion 36 (not shown in FIGS. 9B-10B for clarity) enters the coupling portion 62. As the distal edge of the adapter 34 makes contact with the plug 72, the plug 72 begins to move in a downward direction relative to the base 68 it is disposed through. At the same time, the cap 82 of the plug 72 is pushed out of the aperture 70 defined within the base 68. Because the plug 72 is coupled to the spring 64, the spring 64 begins to compress while the cap 82 continues to move distally out of and away from the base 86.

As the user continues to push the syringe 32 into the sealing device 10, the adapter 34 continues to push into the plug 72 and move it downward towards the base 68, thereby causing the spring 64 is compress from an expanded configuration seen in FIG. 9C into a compact configuration seen in FIG. 10B. As the plug 72 is compressed, the lumen 76 and the cap 80 are also move downward relative the base 68, thereby exposing the apertures 84 defined within the plug 82 and creating an open path or channel for fluid to flow between the medication vial 1 and the syringe 32.

After the distal locking portion 36 of the syringe 32 has been fully inserted into the coupling portion 16 and secured as discussed above, the movement of the plug 72 ceases its movement and the spring 64 remains in a compressed configuration as seen in FIG. 10B with the apertures 84 of the plug 72 disposed at a maximum open position. Next, the user actuates a plunger disposed in the syringe 32 to withdraw medication from the medication vial 1 as is discussed above then detaches the syringe 32 from the coupling portion 16 once a desired medication dosage has been obtained. As the adapter 34 is pulled proximally away from the valve 14, the adapter 34 is removed from the coupling portion 16 which allows the spring 64 to relax or expand back into its initial form as seen in FIGS. 9B and 9C. More specifically, the resilient, semi-elastic material of the spring 64 permits the plug 72 to return to its original position which naturally and automatically withdraws the plug 72 back into the base 68 which in turn once again obstructs or closes the apertures 84 defined in the plug 72. The closing or resealing of the apertures 84 stops all fluid flow to or from the medication vial 1, even if the medication vial 1 itself is inverted. The user continues to remove the syringe 32 so that the adapter 34 is pulled from the coupling portion 16 thereby clearing the syringe 32 from the sealing device 60 completely.

Having removed from the syringe 32 filled the medication fluid from the sealing device 60, the user may apply a needle to the syringe 32, apply the syringe 32 to an intravenous tube or bag, or perform any other procedure requiring a syringe as is known in the art or later devised. Alternatively, the user may reinsert the syringe 32 into the sealing device 60 and reopen the apertures 84 as disclosed above and either draw more medication fluid, or reinject the medication fluid contained within the syringe 32 back into the medication vial 1. Because of the close seated or tight connection which is formed between the syringe 32 and the medication vial 1 via the sealing device 60, anytime medication fluid is taken from or injected into the medication vial 1 air is prevented from being withdrawn by the syringe 32 upon its actuation, thereby allowing the user to immediately withdraw medication fluid without having to adjust for any air which may have been inadvertently permitted to enter the syringe 32. In emergency conditions, this further allows the user to inject or apply the medication fluid or drug more quickly to the patient which in turn could improve their medical treatment or even potentially be lifesaving.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An apparatus for selectively withdrawing a fluid from a medication vial, the apparatus comprising:

a seat comprising a cylindrical surface nested entirely within a neck of the medication vial;

a valve disposed within the seat;

a coupling portion coupled to the valve;

a stopper disposed within an internal volume of the valve, the stopper comprising means for varying its vertical position relative to the valve; and at least one aperture defined within the valve, wherein the stopper comprises means for closing the at least one aperture and for maintaining a top portion of the stopper at a position that is flush with an opening of the coupling portion when in an expanded configuration, wherein the stopper comprises means for opening the at least one aperture when in a compressed configuration, wherein the stopper comprises a hollow internal channel defined throughout its height, and wherein the coupling portion comprises a male thread disposed on an outer surface and along an entire height of the coupling portion.

2. The apparatus of claim 1 wherein the means for varying the vertical position of the stopper relative to the valve comprises a plurality of compressible pleats defined along the height of the stopper.

3. The apparatus of claim 1 wherein the hollow internal channel is configured to accommodate the at least one aperture defined in the valve.

4. The apparatus of claim 1 wherein the male thread disposed along the entire height of the coupling portion is configured to couple to a syringe.

5. The apparatus of claim 4 wherein the top portion of the stopper is configured to contact the syringe when it is coupled to the coupling portion.

6. The apparatus of claim 1 wherein the valve comprises:

a central neck comprising a hollow interior;

an inlet defined in a bottom surface of the valve and fluidically communicated to the hollow interior; and a tip coupled to the central neck, wherein the at least one aperture is defined in the tip.

7. The apparatus of claim 6 wherein the means for closing the at least one aperture when in an expanded configuration comprises a flange configured to close the at least one aperture defined in the tip.

8. The apparatus of claim 6 wherein the inlet defined in the bottom surface of the valve is fluidically communicated to the fluid within the medication vial.

9. A method for withdrawing a fluid from a vial comprising:

coupling a syringe to a male thread disposed on an outer surface and along an entire height of a coupling portion coupled to a valve;

maintaining a top portion of a stopper at a position that is flush with an opening of the coupling portion;

actuating a stopper disposed within an internal volume of the valve;

opening an aperture defined in a valve;

withdrawing the fluid from the vial through the valve and into the syringe; and closing the aperture defined in the valve; and decoupling the syringe from the coupling portion, wherein actuating the stopper disposed within an internal volume of the valve comprises automatically compressing the stopper as the syringe is coupled to the coupling portion, wherein automatically compressing the stopper as the syringe is coupled to the coupling portion comprises exposing a stationary central neck disposed through a hollow internal channel defined through a height of the stopper, and wherein closing the aperture defined within the valve comprises automatically closing the aperture defined within the valve as the syringe is decoupled from the coupling portion.

10. The method of claim 9 wherein closing the aperture defined in the valve comprises covering the aperture with a flange disposed on the stopper.

11. The method of claim 9 wherein actuating the stopper disposed within an internal volume of the valve comprises varying a vertical position of the top of the stopper relative to the aperture defined in the valve.

12. The method of claim 9 wherein withdrawing the fluid from the vial through the valve and into the syringe comprises withdrawing the fluid through a hollow interior defined within the central neck within the valve.

13. The method of claim 9 wherein automatically compressing the stopper as the syringe is coupled to the coupling portion comprises pushing the top portion of the stopper with a distal portion of the syringe.

14. The method of claim 13 wherein automatically closing the aperture defined within the valve as the syringe is decoupled from the coupling portion comprises relaxing the top portion of the stopper with the distal portion of the syringe.

15. The method of claim 9 wherein compressing the stopper as the syringe is coupled to the coupling portion comprises compressing a plurality of pleats defined along a height of the stopper.

16. The method of claim 15 wherein closing the aperture defined in the valve comprises expanding the plurality of pleats defined along the height of the stopper as the syringe is decoupled from the coupling portion.

17. The method of claim 9 further comprising inserting the central neck of the valve into a distal locking portion of the syringe.

18. The method of claim 17 wherein opening the aperture defined in the valve occurs simultaneously as the central neck is inserted into the distal locking portion of the syringe.

19. The method of claim 17 wherein withdrawing the fluid from the vial through the valve and into the syringe comprises withdrawing the fluid from a tip of the central neck directly into the distal locking portion of the syringe.

* * * * *